US005635886A

United States Patent [19]

Pichard

[11] Patent Number: 5,635,886

[45] Date of Patent: Jun. 3, 1997

[54] CUTOFF STRUCTURE FOR CIRCUIT BREAKER

[75] Inventor: Christian Pichard, Asnieres le Dijon, France

[73] Assignee: Schneider Electric, France

[21] Appl. No.: 356,308

[22] PCT Filed: Apr. 20, 1993

[86] PCT No.: PCT/FR93/00386

§ 371 Date: Dec. 20, 1994

§ 102(e) Date: Dec. 20, 1994

[87] PCT Pub. No.: WO94/24682

PCT Pub. Date: Oct. 27, 1994

[51] Int. Cl.[6] ..... H01H 67/02

[52] U.S. Cl. ..... 335/132; 335/202

[58] Field of Search ..... 335/131–132, 335/202, 6, 14, 20, 16, 147

[56] References Cited

U.S. PATENT DOCUMENTS 3,436,497 4/1969 Mading .

5,233,321 8/1993 Blanchard et al. ..... 335/132

FOREIGN PATENT DOCUMENTS 0676976 2/1966 Belgium .

1443954 5/1966 France .

2446538 8/1980 France .

2530863 1/1984 France .

*Primary Examiner*—Lincoln Donovan

*Attorney, Agent, or Firm*—William A. Drucker

[57] ABSTRACT

The cutoff structure for a circuit breaker comprising, for each pole, a contact bridge (17) lodged in a push button (20). The push button is guided in a fixed cage (21) mounted in the box of the circuit breaker, the cage being fitted with passage windows (24) for the contact bridge and with an upper stop (26) for the bridge, so as to constitute a telescopic sub-assembly.

7 Claims, 1 Drawing Sheet

CUTOFF STRUCTURE FOR CIRCUIT BREAKER

This invention relates to a cutoff structure with contact bridge for circuit breaker comprising, in a box and for each pole, a mobile contact bridge associated with fixed contacts and a contact pressure spring, the bridge being pushed against the spring by a push button which is secured to a mechanism for opening and closing the contacts.

Such structures are well known and, in combination with arc extinguishing assemblies, have as function to open the contacts of the respective poles in response to a command that is voluntary or subsequent to an electrical fault communicated to the opening-closing mechanism. Experience has shown that it is desirable to confer, upon such a contact-holder structure, additional functions facilitating the assembly and/or functioning of the circuit breaker.

In particular, the object of the invention is to transfer, to the structure with contact bridge, functions such as push button guidance and/or arc confinement functions, usually devolving upon the circuit breaker box.

According to the invention, the push button of the contact bridge is guided in a fixed cage mounted in the circuit breaker box. The push button guidance function is therefore transferred to the cutoff structure. When the fixed cage has a stop for the contact bridge in the direction corresponding to the springing back of the spring, the cutoff structure can be constructed as a telescopic sub-assembly fitting easily into the circuit breaker box.

The push button preferably comprises at least one port dimensioned to allow introduction of the contact bridge and an angular clearance of the bridge in relation to the push button, the clearance being thus made possible though the push button is guided for translation in the fixed cage.

In a preferred embodiment, the fixed cage comprises insulating lateral wings and a corresponding extension of its base wall for constituting cutoff prechambers that can be embraced by the ends of fins of arc extinguishing structures.

The invention will now be explained by a description of a non-limiting example, in reference to the following figures.

Figure 1:
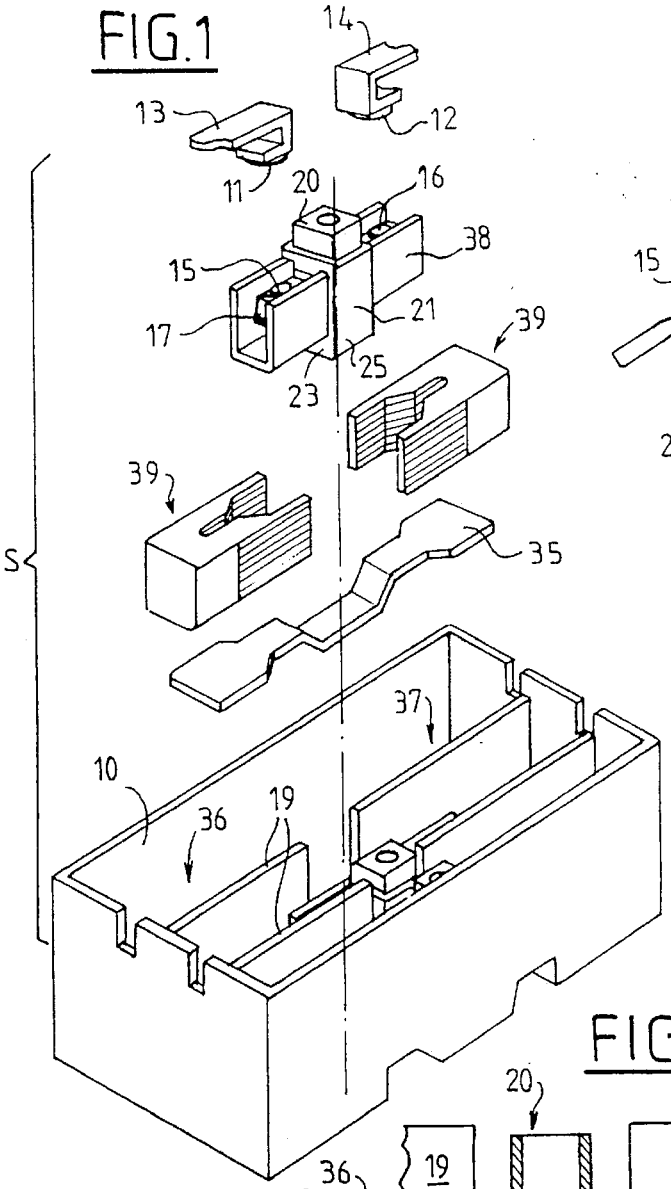
FIG. 1 represents an exploded perspective of a circuit breaker mounting base equipped with cutoff structures according to the invention.

The circuit breaker illustrated in FIG. 1 comprises a box in insulating material 10 of which are represented only the mounting base part and, in this box, several polar current paths each equipped with a cutoff structure S with separable contacts. In this way, each polar path comprises two fixed contacts 11, 12 disposed on fixed contact parts 13, 14 connected to terminals that are not indicated. It further comprises two mobile contacts 15, 16 respectively associated with the fixed contacts 11, 12 and disposed on an electrically conductive and mobile bridge 17 to constitute a double-cutoff polar switch. Of the elements of the box cooperating with the cutoff structure, a base wall 18 and partitions 19 between the poles can be noted.

The mobile contact bridge 17 is acted upon by a mechanism (not represented) for opening and closing the contacts, by means of a push button 20 guided according to the invention in a fixed cage 21. The cage 21 is in an insulating material and comprises a base wall 22, side walls 23 perpendicular to the partitions 19 between the poles, and fitted with windows 24 and blank side walls 25 parallel to the partitions 19. The base wall 22 of the cage is positioned on the mounting base 18 of the box 10.

Figure 2:
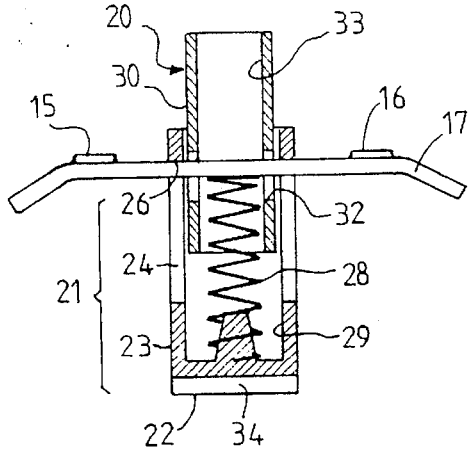
FIG. 2 is an elevation of a first embodiment of the cutoff structure.

FIG. 2 illustrates further details of a first embodiment of the cutoff structure S. It should be noted that the windows 24 of the side walls 23 of the fixed cage are dimensioned to enable displacement of the contact bridge, notably under the effect of the opening-closing mechanism in the case of electrodynamic repulsion. In addition, the windows 24 determine an upper stop 26 for the contact bridge 17. A contact-pressure helical spring 28 is lodged between the base wall 22 of the cage and the contact bridge 17 in a central recess 29 of the cage 21 which also serves to lodge and to guide the push button 20 for translation. The latter is thus guided against the inner sides of the side walls 23, 25 of the cage by respective walls 30, 31. The walls 30 of the push button are indented by ports 32 dimensioned to enable, on the one hand, introduction of the bridge in the push button, and, on the other hand, angular clearance of the bridge in relation to the push button. A central orifice 33 is provided in the push button to allow the spring 28 to pass. The base wall 22 of the fixed cage has a recessed part 34 serving for the passage of a flat and bent arc deflection part connecting the respective cutoff chambers 36, 37 to one another.

Figure 3:
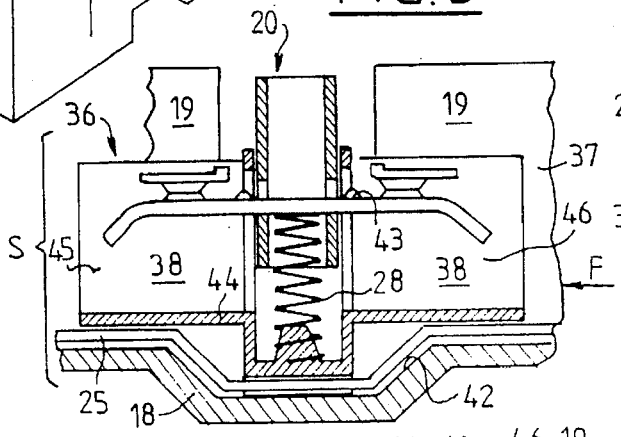
FIG. 3 is an elevation of a second embodiment of the cutoff structure, with partial representation of neighbouring elements of the circuit breaker box.
Figure 4:
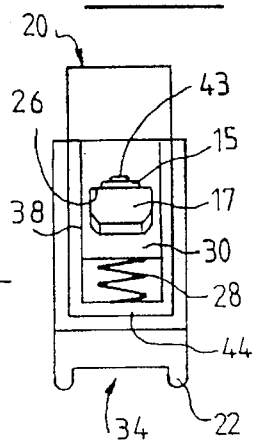
FIG. 4 is a side view according to arrow F of FIG. 3.
Figure 5:
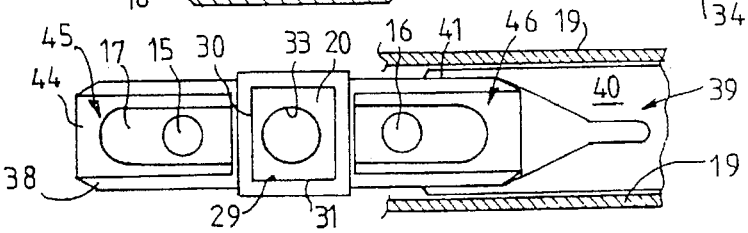
FIG. 5 is a top view, with partial illustration of neighbouring elements.

In the embodiment in FIGS. 3 to 5, the fixed cage 21 of the cutoff structure S comprises insulating wings 38 parallel to the partitions 19 between the poles and extending longitudinally over a distance slightly greater than the length of the bridge 17 and sufficiently high to create a volume containing the interruption arcs. Finned assemblies 39, whose function it is to divide the arcs into fractions and extinguish them, comprise a certain number of fins 40, generally U-shaped and open towards the contacts side. The U-shaped open area embraces, by means of its wings 41, the insulating wings 38 of the fixed cage.

The base wall 22 of the fixed cage advantageously protrudes to lodge itself in a central cavity 42 corresponding to an outward protrusion of the base 18 of the box 10, in order to reduce the overall height of the circuit breaker. Pins 43 are provided on the bridge 17 for cooperating with corresponding forms in the walls 30 of the push button 20, in order to maintain the bridge centered in relation to the push button.

The wings 38 of the cutoff structure can be seen to define, with a corresponding shell 44 which extends the base wall 22 of the cage, cutoff prechambers 45, 46 lodged in the chambers 36, 37. The fixed cage 21 is advantageously in a different material to that of the mounting base of the box since the cage withstands the main cutoff constraints. The structure described with regard to a circuit breaker applies, of course, to different protective switch devices, notably to directional relays.

I claim:

1. A cutoff structure for circuit breaker comprising a box in insulating material having at least one partition wall separating at least two polar current paths, each current path comprising:

a mobile contact bridge associated with fixed contacts and urged against said fixed contacts by a contact pressure spring, said bridge being pushed against said spring by a push button which is secured to a mechanism for opening and closing said contacts, a cage in insulating material removably fixed in said box and comprising means for guiding said push button, passage windows for said contact bridge, enabling displacement of said contact bridge under the effect of said mechanism and in the case of electrodynamic repulsion, and insulating lateral wings delimiting an arc confinement volume enclosing said contact bridge.

2. The structure as claimed in claim 1, wherein said fixed cage has a stop for said contact bridge in the direction corresponding to the springing back of said spring.

3. The structure as claimed in claim 1, wherein said push button bears said contact bridge and comprises at least one port dimensioned to allow introduction of said contact bridge into said push button and an angular clearance of said bridge in relation to said push button.

4. The structure a claimed in claim 1, wherein said insulating wings are embraced by open areas of finned arc extinguishing assemblies.

5. The structure as claimed in claim 1, wherein said fixed cage comprises a base wall positioned on the mounting base of said box.

6. The structure as claimed in claim 5, wherein there is provided, between said base wall of said cage and said mounting base of the box, a flat deflector connecting the cutoff chambers to one another.

7. The structure as claimed in claim 1, wherein the material of said fixed cage differs from that of the neighbouring areas of said box of said circuit breaker.

* * * * *